US005813478A

United States Patent [19]

Kettner

[11] Patent Number: 5,813,478

[45] Date of Patent: Sep. 29, 1998

[54] PULSE TOOL

[75] Inventor: Konrad Kettner, Aalen, Germany

[73] Assignee: Deutsche Gardner-Denver GmbH & Co., Westhausen, Germany

[21] Appl. No.: 689,129

[22] Filed: Jul. 30, 1996

[30] Foreign Application Priority Data

Aug. 17, 1995 [EP] European Pat. Off. ..... 95112983

[51] Int. Cl.[6] ..... B25B 19/00

[52] U.S. Cl. ..... 173/93; 173/93.5; 173/218

[58] Field of Search ..... 173/93, 93.5, 218, 173/168

[56] References Cited

U.S. PATENT DOCUMENTS

| | | | |
|---|---|---|---|
| 3,192,739 | 7/1965 | Brown | 464/25 |
| 3,304,746 | 2/1967 | Kramer et al. | 464/25 |
| 4,175,408 | 11/1979 | Kasai et al. | 464/25 |
| 5,172,772 | 12/1992 | Kettner et al. | 173/93 |

FOREIGN PATENT DOCUMENTS

| | | |
|---|---|---|
| A-254699 | 1/1988 | European Pat. Off. . |
| A-569344 | 11/1993 | European Pat. Off. . |
| A-665087 | 8/1995 | European Pat. Off. . |
| A-1478940 | 3/1969 | Germany . |

*Primary Examiner*—Scott A. Smith

*Attorney, Agent, or Firm*—Burns, Doane, Swecker & Mathis LLP

[57] ABSTRACT

A pulse tool, especially a nutsetter, comprises a pulse unit including a hydraulic cylinder driven by a motor, and a driven shaft supported in the hydraulic cylinder. Two seal rollers are supported in radial grooves of the driven shaft. The rollers are power-operated towards the inner wall of the cylinder. The seal rollers are simultaneously in contact only in a single rotary position of the cylinder with seal strips that project relative to the inner wall of the cylinder so as to produce an angular momentum. To simplify the structure of the pulse tool and to extend the period of use at the same time, the radial groove which receives the seal roller serving as a compensating roller comprises a lift delaying device for the limited centrifugal movement of the compensating roller.

23 Claims, 4 Drawing Sheets

PULSE TOOL

BACKGROUND OF THE INVENTION

The present invention relates to a pulse tool, especially a nutsetter, comprising a pulse unit which includes a hydraulic cylinder driven by a motor and a driven shaft supported in said cylinder, with two seal rollers being displaceably supported in the radial grooves of the driven shaft and power-operated towards the inner wall of the cylinder, which seal rollers are simultaneously in contact only in a single rotary position of the cylinder with seal strips that project relative to the inner wall of the cylinder so as to produce an angular momentum.

Such a pulse tool is known from EP 0 254 699 B1. In the already known tool the seal rollers are always in contact with a rolling surface and are in contact with corresponding seal strips, especially after half a turn of the hydraulic cylinder. Ribs which project at the driven shaft and extend in inclined fashion relative to a rotary axis of the driven shaft are offset by 90° relative to the seal rollers. Corresponding rib-like projections are also provided on the inner wall of said hydraulic cylinder.

The inclination of the ribs on the driven shaft and the inner wall of the hydraulic cylinder ensures that it is only in one single rotary position of the cylinder that the seal rollers and the ribs define four chambers that are separated from one another and disposed between driven shaft and inner wall of the hydraulic cylinder. Two respective ones of said chambers are high-pressure chambers, and low-pressure chambers, respectively. The pressure difference between these chambers produces an angular momentum in the known manner, the angular momentum being transmitted via the driven shaft for securing or unscrewing a screw or nut.

A longer acceleration phase is given during the rotary movement due to the generation of a respective pulse after a rotation of 360° of the hydraulic cylinder, and an increased pulse can thus be produced.

The pulse tool of the prior art has the disadvantage that the structure of the pulse unit is relatively complex. Apart from the two seal rollers and radial grooves, two respective ribs must be constructed on the driven shaft and on the inner wall of the hydraulic cylinder, with the ribs extending in an inclined manner. The manufacture of the prior-art pulse tool is thus made more difficult and expensive. Finally, another disadvantage is that the ribs must be manufactured with high accuracy, so that the seal between the ribs of driven shaft and hydraulic cylinder is satisfactory. A certain wear of the ribs and thus a deterioration of the sealing action can, however, not be avoided after a certain time of use of the pulse tool.

SUMMARY OF THE INVENTION

It is therefore the object of the present invention to improve the prior-art pulse tool such that the structure of the pulse tool is simplified and the time of use extended at the same time.

This object is achieved in a pulse tool comprising the features of the preamble of claim 1 in that for the limited centrifugal movement of a seal roller, which serves as a compensating roller, the radial groove thereof comprises a lift delaying means.

Such a lift delaying means ensures that although the compensating roller performs a radial movement to the outside towards the hydraulic cylinder in its radial groove, this movement is delayed during one turn of the cylinder such that the compensating roller is in contact with a seal strip only in a single rotary position. The radial movement can be delayed to such an extent that the compensating roller is in contact with a sealing surface only temporarily and at points, also during the further rotation of the hydraulic cylinder. As a result, a corresponding incompressible medium, such as a hydraulic fluid, can flow between driven shaft and hydraulic cylinder without being hindered in any way, and it is only in the single rotary position, i.e. the pulse position, that the interior between driven shaft and hydraulic cylinder is separated into two chambers, a high-pressure chamber and a low-pressure chamber.

In contrast to the known pulse tool, additional ribs are not needed on the driven shaft and/or the inner wall of the hydraulic cylinder with a selected inclination. Since the seal rollers are power-operated towards the inner wall, the rollers are still in contact with the seal strips in the pulse position, even in the case of long periods of use of the pulse tool, so that a pulse can be transmitted.

Although EP 0 353 106 B1 discloses a pulse tool in which ribs formed on the driven shaft are not required, four so-called seal wings and rollers are arranged instead of said ribs and all of them are supported in corresponding grooves of the driven shaft in a substantially radially displaceable manner. The grooves for the seal wings extend along a diameter of the driven shaft while the corresponding grooves for the rollers enclose an obtuse angle of less than 180°. Such an inclination of the grooves for the rollers relative to one another ensures that a pulse is only transmitted in a single rotary position per 360° of rotation. The efforts for making the pulse tool and the corresponding costs are again relatively high. A lift delaying means of the invention for a compensating roller is not disclosed; instead, the identical rollers are guided in identical dovetailed grooves which prevent the rollers from exiting from their grooves.

To further simplify the manufacture of the pulse tool according to the invention, compensating roller and an additional seal roller, which serves as a pulse roller, as well as associated radial grooves, are offset by 180° relative to one another.

An embodiment of a lift delaying means is characterized in that that said means is formed by the compensating roller being guided in its radial groove, the compensating roller being guided in its radial groove with less play than the pulse roller. Such a play has the effect that hydraulic fluid cannot be replaced entirely through the small play between radial groove and compensating roller during one complete turn of the hydraulic cylinder. The delayed fluid exchange additionally effects a certain negative pressure between compensating roller and radial groove, the pressure enhancing the lift delay.

Instead of this, the play between radial groove and pulse roller is so great that hydraulic fluid is replaced substantially already directly after contact with the associated seal strip and the pulse roller is thus unlimited or not delayed in its radial movement. It goes without saying that the radial movment of the compensating roller is limited at least to such an extent that it is respectively in contact with the associated seal strip in the pulse position.

A different play between radial grooves and seal rollers can be produced in that e.g. compensating roller and pulse roller have the same dimensions and the radial grooves have different widths. It is also possible that the radial grooves have the same dimensions and compensating roller and pulse roller have different diameters. The radial grooves may here be formed with a substantially rectangular cross-section which is open towards the circumference of the driven shaft.

In both cases it is possible by selecting corresponding dimensions to guide the compensating roller in its radial groove with a play that is smaller than that of the pulse roller.

Power operation of the seal roller towards the inner wall of the cylinder can easily be performed in that a spring element, especially a leaf spring, is arranged between groove bottom and seal rollers.

It is here possible to implement the lift delaying means in addition to the above-mentioned guides in that the spring constant of the associated spring element is smaller than the spring constant of the spring of the pulse roller for a limited radial movement of the compensating roller.

Since especially the inner wall of the hydraulic cylinder and the seal strips are subject to heavy wear during operation of the pulse tool, it is advantageous when the inner wall of the hydraulic cylinder is formed at least in the area of the seal rollers by a hydraulic sleeve on the inside of which the seal strips are arranged. In case of wear of the seal strips it is only the hydraulic sleeve which must be replaced. The remaining pulse unit continues to be usable.

To form the high-pressure and low-pressure chambers in the position of angular momentum in a simple manner, pockets are formed on the inside of the hydraulic sleeve between the seal strips. The pockets may be of an identical type or may be produced with different dimensions for high-pressure and low-pressure chambers.

With a simple structure of the hydraulic sleeve, the pockets are defined by inner ring flanges which project radially from the inside of the hydraulic sleeve and along which at least the pulse roller rolls, whereas the compensating roller rolls e.g. along the inner ring flange only for a short period of time before the pulse position is reached. Normally, the inner ring flange is formed by end sections of the hydraulic sleeve in axial direction.

To permit a reliable and smooth guidance for the seal rollers, the inner ring flanges define two circles that are concentric to each other and are eccentrically arranged inside the cylinder and that are touched by the seal strips. At least the pulse roller rolls along said circles.

To further simplify production of the pulse tool and, in particular, of the pulse unit, it has been found to be advantageous when ends of the seal strips are formed by diametrically opposite sections of the inner ring flanges. A separate construction of seal strips and inner ring flanges is thus not necessary. The seal strips extend in axial direction from one inner ring flange to the other one.

To fix hydraulic sleeve and seal rollers inside the hydraulic cylinder in a simple manner, these members are arranged inside the hydraulic cylinder between two lateral contact washers, the contact washer next to the motor resting on a radially inwardly projecting shoulder of the hydraulic cylinder and the opposite contact washer resting on a bearing ring which can be screwed into the hydraulic cylinder.

For instance, for filling the pulse unit with hydraulic fluid it is advantageous when a central hole is concentric to the driven shaft and is formed therein at least over part of the length of the driven shaft. Prior to a first use of the pulse tool, the hydraulic fluid can be introduced into the pulse unit at a specific pressure via corresponding openings between central hole and interior of the hydraulic sleeve.

Furthermore, the central hole can be used for determining the pressure within the fluid chamber formed between driven shaft and hydraulic sleeve. It is advantageous when at least one respective connection hole is formed in the driven shaft between the radial grooves, the connection hole connecting central hole and fluid chamber. The pressure may here be determined in the known manner via a corresponding pressure sensor.

To produce the connection hole in a simple manner, the hole is radially formed in the driven shaft and offset by 90° each relative to the radial grooves.

To build up an adequate pressure in the high-pressure chamber until the pulse position is reached, it is advantageous when a throttle hole is formed between central hole and connection hole with a cross-section that is reduced as compared with the remaining connection hole.

To adjust a passage cross-section of the throttle hole and thus to adjust the hardness of an impact pulse, it has been found to be especially advantageous when a valve screw is screwed into the central hole for closing the throttle hole in an infinitely variable and adjustable manner.

To attentuate vibrations of the pulse unit when the pulses are produced, it is also advantageous when a compensating piston is slid over an end of the hydraulic cylinder that faces the motor, and when the piston is sealed relative thereto.

When for the relative displacement of compensating piston and hydraulic cylinder a valve is arranged between compensating piston and fluid chamber for applying pressure to the area of the compensating piston sealed relative to the hydraulic cylinder, pressure build-up can be monitored through the relative displacement between compensating piston and hydraulic cylinder while the pulse unit is being filled with hydraulic fluid. Moreover, the conclusion can be drawn from a reduction of the relative displacement after the pulse unit has been filled with hydraulic fluid, or from the absence of a displacement during the filling operation, that there is some kind of leakage in the pulse unit.

BRIEF DESCRIPTION OF THE DRAWINGS

An advantageous embodiment of the invention shall now be explained and described in more detail with reference to the attached figures, in which.

DESCRIPTION OF THE PREFERRED EMBODIMENT

Figure 1:
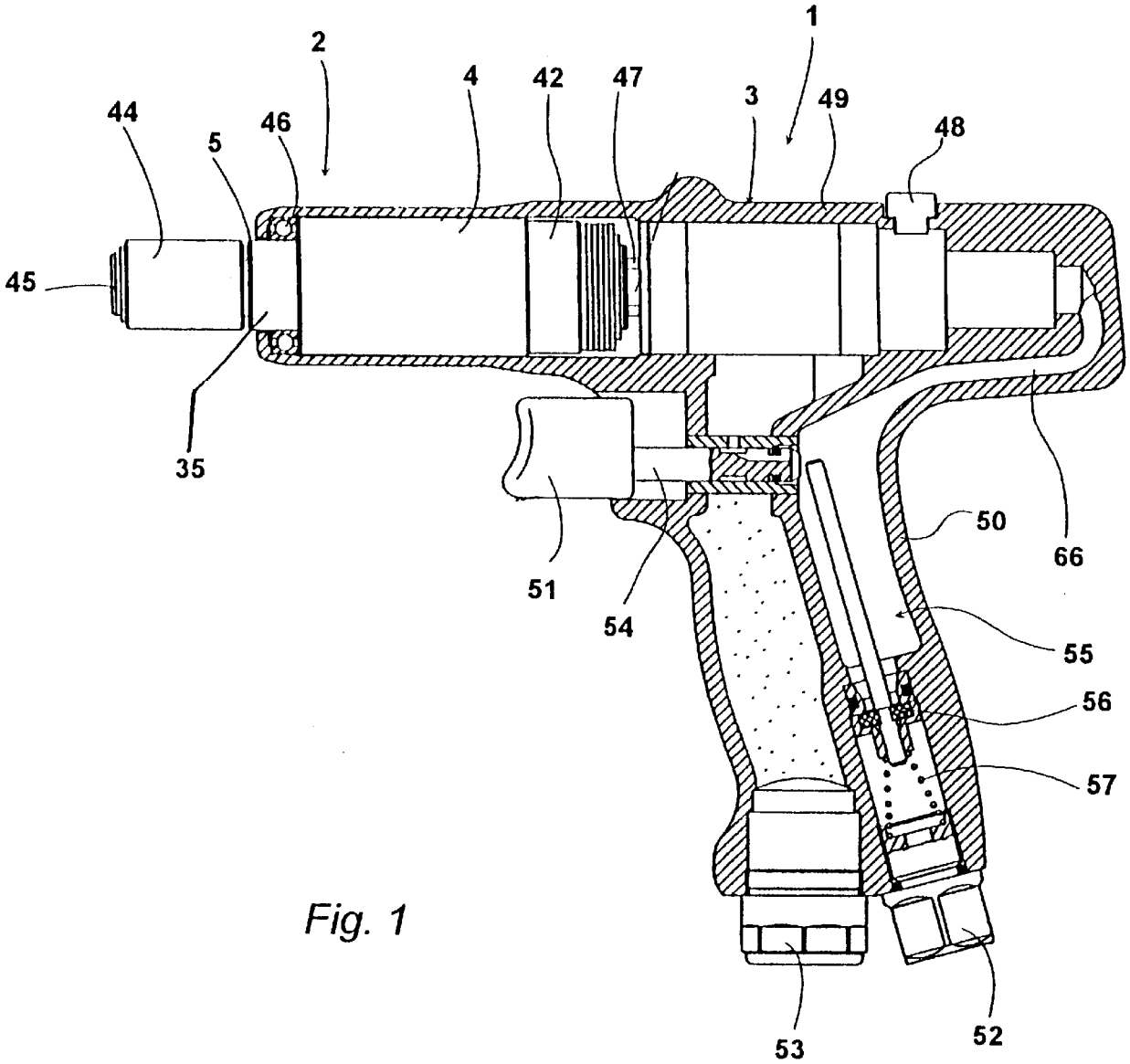
FIG. 1 is a longitudinal section through a pistol-like pulse tool.

FIG. 1 is a longitudinal section through a pulse tool 1. The longitudinal section does not extend through components arranged in a housing 49 of pulse tool 1.

Pulse tool 1 has a pistol-like contour, with a push button 51 and connections 52 and 53 for compressed air and exhaust air being arranged in a handle 50. Push button 51 is movably supported in handle 50 by means of a stem 54. The free end of stem 54 is arranged adjacent to a free end of a tilt valve 55. In moving push button 51 to the right in FIG. 1, tilt valve 55 is also tilted to the right by stem 54. As a result, a valve disk 56 is pivoted against the force of a compression spring 57, releasing an opening for the supply of compressed air via compressed-air connection 52 to a motor 3.

The compressed air moves along a line 66 to the motor 3, which is formed as a compressed-air motor. The rotational direction thereof is switchable by means of a reverse button 48.

Motor 3 has connected thereto via a plug-type connector 47 a pulse unit 2 which rotates with motor 3 accordingly. A transmission with a coupling (not shown) can be arranged between motor 3 and pulse unit 2.

Pulse unit 2 is formed of a hydraulic cylinder 4 rotatably supported in housing 49, a compensating piston 42 mounted thereon at its motor end, a bearing ring 35 and a driven shaft 5. The driven shaft 5 projects from housing 49 in the manner of a pistol barrel, a connection sleeve 44 being attached onto the projecting end thereof.

To rotatably support hydraulic cylinder 4 and/or bearing ring 35 of the driven shaft 5, at least one slide bearing 46 is arranged between said members and housing 49.

The compressed air supplied to motor 3 via line 66 is discharged accordingly from pulse tool 1 via the exhaust-air connection 53.

Figure 2:
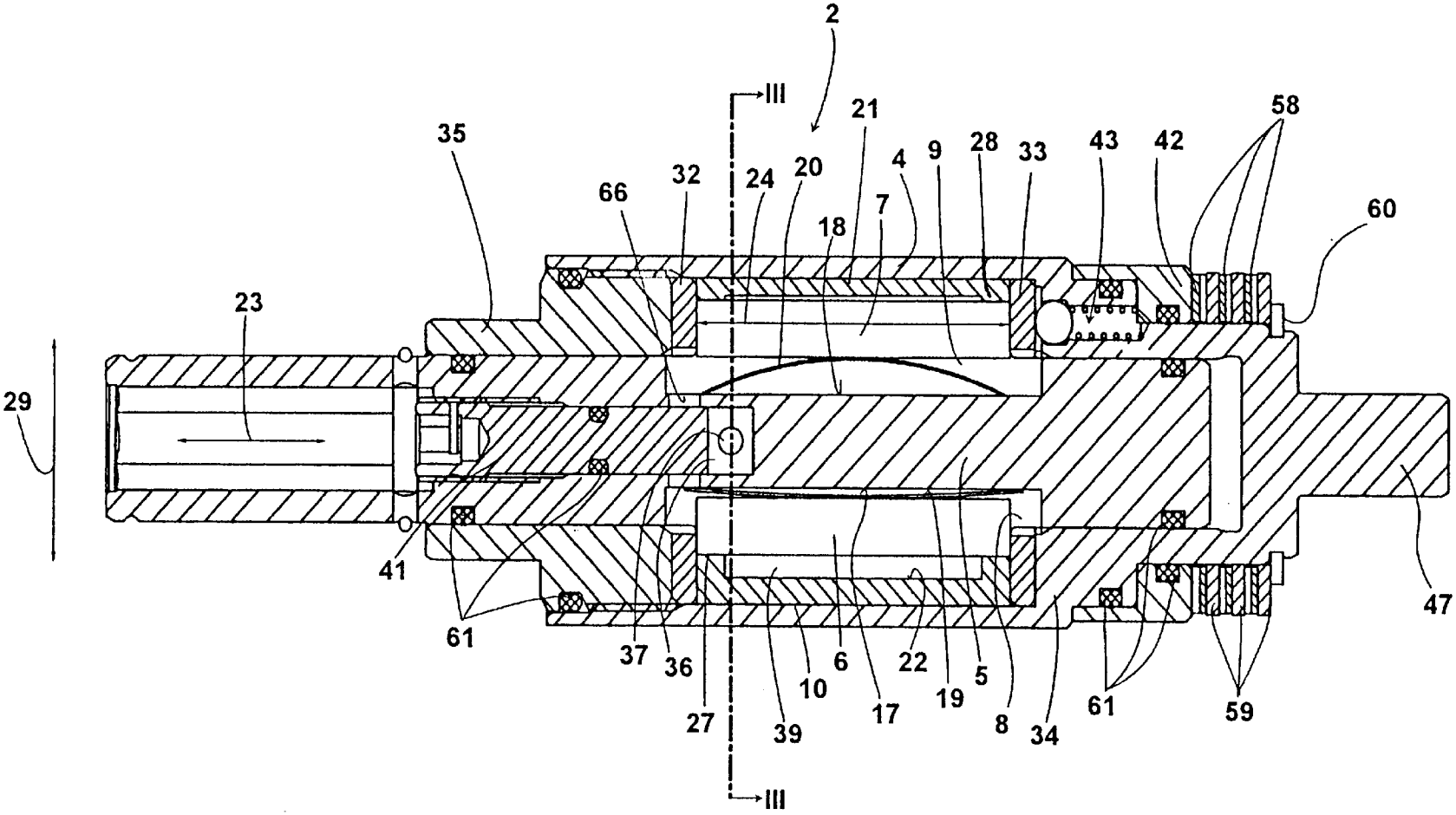
FIG. 2 is a longitudinal section through an enlarged pulse unit of FIG. 1.

FIG. 2 shows the pulse unit 2 of FIG. 1 on an enlarged scale and in longitudinal section.

The hydraulic cylinder 4 of pulse unit 2 is a cylinder that is open at one side. It has inserted thereinto a hydraulic sleeve 21 which rests on the inner wall 10 thereof. Contact washers 32 and 33 rest on both ends in axial direction 23 of hydraulic sleeve 21. The contact washer 33 which is closer to the motor rests on a shoulder 34 of the hydraulic cylinder 4 which projects inwardly in radial direction 29. The shoulder forms a circular stop which is followed in the direction of plug-type connector 47 towards the motor by a cylindrical cavity with a cross-section that is smaller than the cross-section of hydraulic cylinder 4 in the area of hydraulic sleeve 21.

The driven shaft 5 is rotatably supported within the hydraulic cylinder 4 and the hydraulic sleeve 21. The driven shaft 5 extends substantially from the plug-type connector 47 through hydraulic cylinder 4 and projects from the open end thereof. The driven shaft 5 has a substantially circular cross-section, with two diametrically opposite radial grooves 8 and 9, which extend in axial direction 23, being formed in the area of hydraulic sleeve 21 in the driven shaft 5. Furthermore, a central hole 36 which extends concentrically to the driven shaft 5 extends approximately over half the length of the driven shaft 5. This central hole 36 is formed in the projecting end section of the driven shaft 5 with an internal hexagon for receiving nuts or screws.

The driven shaft 5 is rotatably supported in the hydraulic cylinder 4 both in the end section of the hydraulic sleeve which is provided at the motor side and has a reduced cross-section, and in a bearing ring 35 screwed into the open end of the hydraulic sleeve 4. The bearing ring 35 is screwed with its larger-diameter section into the hydraulic sleeve 4 to such an extent that it rests on the contact washer 32 opposite to the hydraulic sleeve 21. Contact washer 32 and 33 and hydraulic sleeve 21 are fixed within the hydraulic cylinder 4 in axial direction by screwing the bearing ring 35.

A seal roller 6 which serves as a compensating roller and a seal roller 7 which serves as a pulse roller are displaceably supported in radial directions 29 in the radial grooves 8 and 9. The length 24 of seal rollers 6 and 7 corresponds to the length of the hydraulic sleeve 21 in axial direction 23. Leaf springs 19 and 20 which apply pressure to the seal rollers radially outwardly are arranged between groove bottoms 17 and 18 of the radial grooves 8 and 9 and seal rollers 6 and 7.

At the side opposite to the radial grooves 8, 9, the seal rollers 6, 7 are in contact with radially inwardly projecting inner ring flanges 27 and 28 of the hydraulic sleeve 21, which form the ends of the hydraulic sleeve 21 in axial direction 23.

The radial grooves 8, 9 extend over a greater length than seal rollers 6, 7 in axial direction 23 and project at both sides over said rollers and contact washers 32 and 33.

To connect the radial grooves 8, 9 with the central hole 36, filling openings 66 are formed at the end of the radial grooves which faces away from the motor. Furthermore, a fluid chamber 39 which is formed between driven shaft 5 and hydraulic sleeve 21 is connected via connection holes 37 and 38 (not shown) to the central hole 36. Connection hole 37 and a throttle hole 40, which will be described later, can be covered in a continuously variable and adjustable manner by a valve screw 41 which is screwed into the central hole 36. In the illustration according to FIG. 2, valve screw 41 is screwed into the central hole 36 only to such an extent that the illustrated connection hole 37 is not covered.

At the motor end of the hydraulic cylinder 4, the compensating piston 42 is attached to the cylinder. To secure the piston and to permit a relative movability between compensating piston 42 and hydraulic cylinder 4, a plurality of equalizing washers 58 and shim rings 59 are attached to the hydraulic cylinder next to plug-type connector 47. These washers and rings are fixed in their position by a circlip 60.

Two O-rings 61 are provided for sealing the compensating piston 42 relative to the hydraulic cylinder 4. Additional O-rings 61 serve to seal the driven shaft 5 within the hydraulic cylinder 4, to seal the bearing ring 35 screwed into the hydraulic cylinder 4, and to seal the driven shaft 5 relative to the bearing ring 35 and the valve screw 41, respectively.

A valve 43 is arranged between fluid chamber 39 and compensating piston 42 within the wall of hydraulic cylinder 4. An associated valve ball rests on contact washer 33 and is power-operated by an associated compression spring towards contact washer 33. Pressurized hydraulic fluid can be supplied via valve 43 to the sealed portion between compensating piston 42 and hydraulic cylinder 4. The compensating piston 42 can thus be moved relative to hydraulic cylinder 4 in FIG. 2 to the right in response to the respectively prevailing pressure.

Six different movement phases of hydraulic cylinder 4 and driven shaft 5 are shown in the following FIGS. 3 to 8, FIG. 3 being a section taken along line III—III of FIG. 2, and FIGS. 4 to 8 a section by analogy with FIG. 3 in subsequent movement phases. Identical parts are respectively characterized by identical reference numerals.

Two circles 30, 31 which are concentric to one another and eccentrically arranged relative to the hydraulic cylinder 4 are defined by the inner ring flanges 27 and 28 according to FIG. 2. Pulse roller 7 and compensating roller 6 are in contact with these circles according FIG. 3. The fluid chamber 39 between driven shaft 5 and inside 22 of the hydraulic sleeve 21 is formed by two pockets 25 and 26 which extend between two seal strips 11 and 12 projecting radially inwardly. The pockets extend between the inner ring flanges 27 and 28 in axial direction 23; see FIG. 2. Since the pockets communicate with each other, an exchange of the hydraulic fluid 63 between the pockets is also possible upon rotation of hydraulic cylinder 4 and hydraulic sleeve 21 in rotational direction 62. It is only in the pulse position according to FIG. 8, that the pockets are separated from one another by contact of the compensating roller 6 and pulse roller 7 on seal strips 11 and 12, respectively. In this position, a pulse is transmitted from cylinder 4 to the driven shaft 5.

Figure 3:
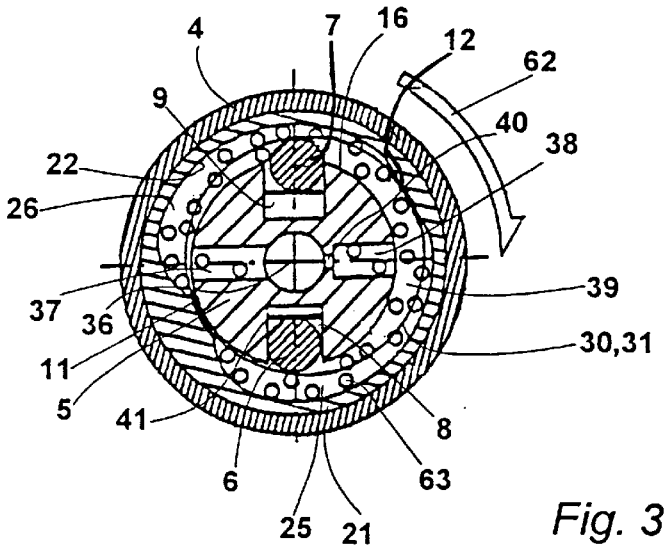
FIG. 3 is a section taken along line III—III of FIG. 2 for illustrating a first movement phase of hydraulic cylinder relative to the driven shaft.

FIG. 3 illustrates connection holes 37 and 39 which are each offset by 90° relative to the seal rollers 6, 7 and diametrically arranged to one another. The connection hole 38 is connected by means of a throttle hole 40 to the central hole 36. The cross-section of the throttle hole is smaller than the cross-section of connection hole 38.

FIG. 3 represents a movement phase which is turned by 60° relative to a pulse position in rotational direction 62. In the movement phases according to FIGS. 4 to 8, the hydraulic cylinder 4 including hydraulic sleeve 21 is turned by another 60° each relative to the driven shaft 5 in a corresponding manner.

Figure 4:
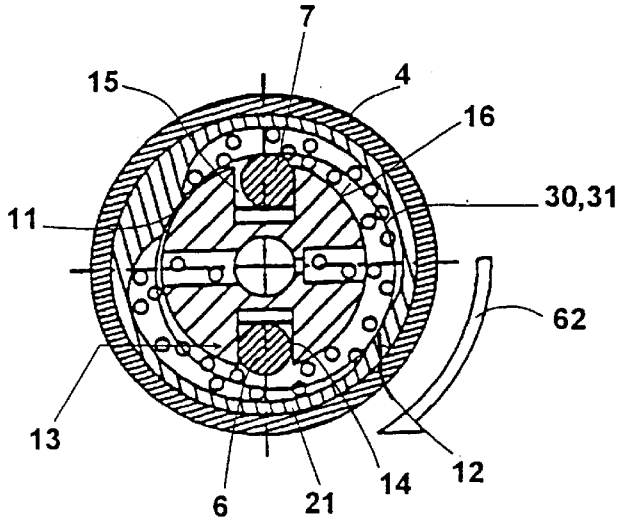
FIG. 4 shows a second movement phase by analogy with FIG. 3.

In the next movement phase according to FIG. 4, the effect of the lift delaying means 13 can be seen. While the pulse roller 7 is in contact with circles 30, 31 because of the power operation by spring leaf 20 and because of the roller being guided in radial groove 9 with a relatively great play 15, a delayed radial movement towards circles 30, 41 takes place in compensating roller 6. This is due to the lift delaying means 13 which due to the compensating roller being guided in its radial groove 8 takes place with a play 14 that is smaller than play 15 of the pulse roller 7. Apart from the compensating roller 6 being guided in its radial groove 8, the lift delaying means 13 can additionally be formed by a further leaf spring 19 having a spring constant which is smaller as compared with leaf spring 20, whereby the restoring force acting on compensating roller 6 is smaller than in pulse roller 7.

Figure 5:
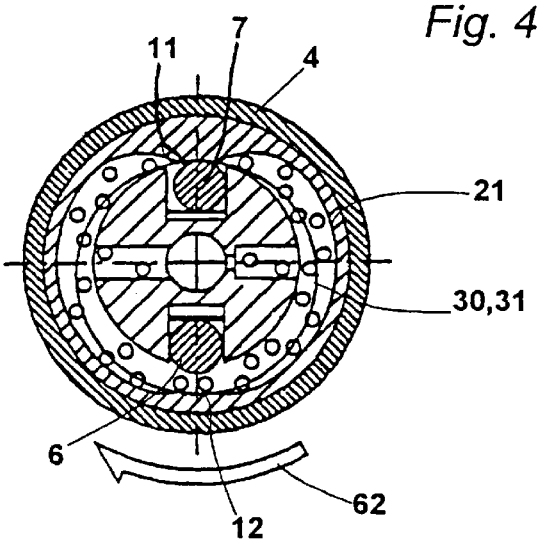
FIG. 5 shows a third movement phase by analogy with FIG. 3.

In FIG. 5, the pulse roller 7 is in contact with sealing strip 11 whilst the compensating roller 6 is arranged in spaced apart relationship with the other seal strip 12 because of the lift delaying means 13. As a result, there is further exchange of hydraulic fluid 63 (see FIG. 3) between pockets 25 and 26.

Figure 6:
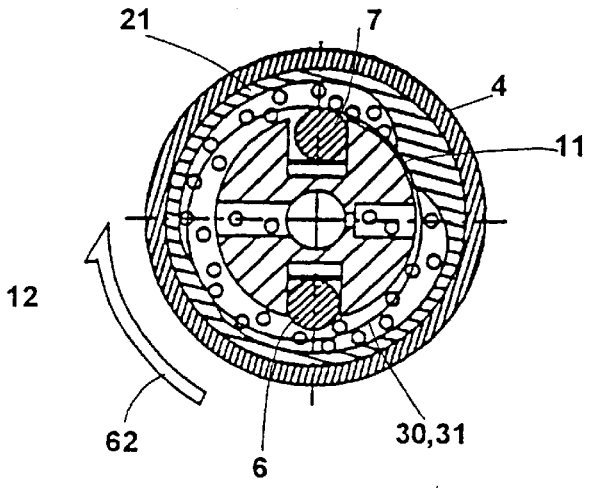
FIG. 6 shows a fourth movement phase by analogy with FIG. 3.
Figure 7:
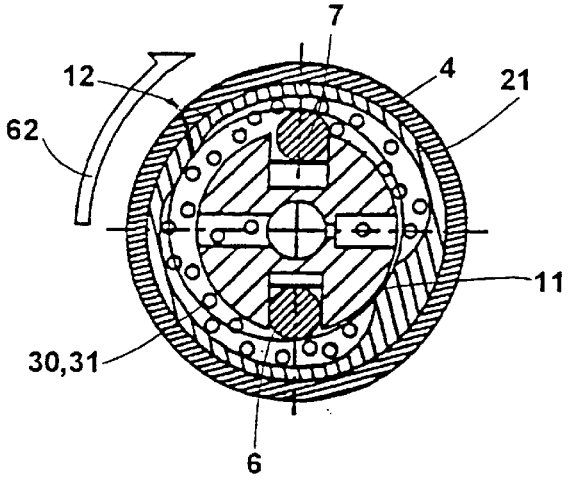
FIG. 7 shows a fifth movement phase by analogy with FIG. 3.

In FIG. 6, hydraulic cylinder 4 and hydraulic sleeve 21 are turned by another 60° in rotational direction 62 relative to the driven shaft 5.

After another rotation by 60°, the compensating roller 6 is in contact with circles 30, 31, i.e., it rests on the inner ring flanges 27 and 28 according to FIG. 2.

Figure 8:
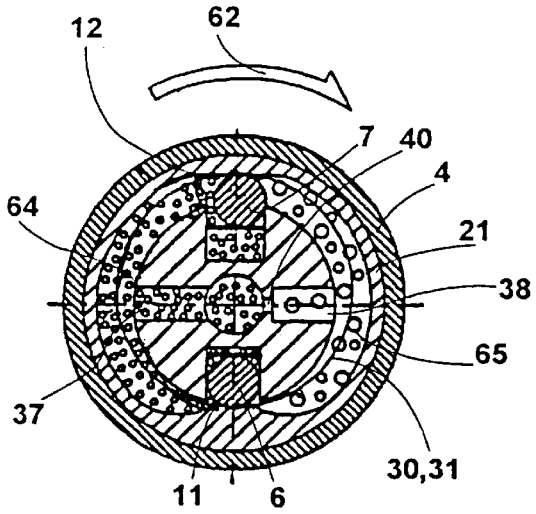
FIG. 8 shows a sixth movement phase by analogy with FIG. 3, the driven shaft and hydraulic cylinder being in a pulse position.

In the last movement phase according to FIG. 8, the pulse position, both compensating roller 6 and pulse roller 7 are in contact with corresponding seal strips 11 and 12, respectively, so that pockets 25, 26 are separated from one another and an exchange of hydraulic fluid between said pockets can no longer take place. As a result, pocket 26 becomes a high-pressure chamber 64 and pocket 25 (see FIG. 3) a low-pressure chamber 65. The different pressure ratios in the chambers are represented by a different number and a different size of circles for illustrating the hydraulic fluid 63.

The connection of high-pressure chamber 64 and low-pressure chamber 65 via the connection holes 37 and 38 and via throttle hole 40 can be defined by correspondingly screwing the valve screw 41 according to FIG. 2, whereby the hardness of the pulses transmitted to the driven shaft 5 in FIG. 8 can be adjusted.

Following FIG. 8, the movement phases of FIGS. 3 to 8 are repeated, the driven shaft 6 being further turned after each pulse transmission by a small angle in rotational direction 62.

The seal strips 11 and 12 are provided with different heights, so that the compensating roller 6 moves out of its radial groove over circumference 16 of the driven shaft 5 because of the lift delaying means 13 during one turn of the hydraulic cylinder 4 to such an extent that it only gets into contact with the radially further inwardly projecting seal strip 11. Furthermore, it should be noted that the seal strips 11 and 12 extend between the inner ring flanges 27 and 28 and connect the same. They are formed with the same height as said flanges, so that in the pulse position according to FIG. 8 compensating roller 6 and pulse roller 7 are in contact with the inner ring flanges 27 and 28, respectively, and the seal strips 11 and 12, respectively, over their entire length 24.

Furthermore, it should be noted that the seal strips 11 and 12, respectively, are illustrated for emphasizing purposes with an exaggerated height. For the same reason the illustration of per se known components, such as a switch-off means for the motor when a set torque, or the like, has been reached, has been dispensed with in FIGS. 1 and 2.

The function of the pulse tool should briefly be described in the following text with reference to the figures.

When screws or nuts are screwed by means of the pulse tool, hydraulic cylinder 4 and driven shaft 5 are rotated by the friction existing between said members and by the rotational movement of motor 3. As soon as the screw or nut is in contact, it is only hydraulic cylinder 4 with hydraulic sleeve 21 that is further rotated by motor 3, an angular momentum being transmitted to the driven shaft 5 in every pulse position according to FIG. 8, whereby the screw or nut is further screwed in by a specific angle of rotation. The sum of all of these angles of rotation transmitted upon every angular momentum gives the total tightening angle and, by analogy, a tigthening torque for the screw/nut. In monitoring the pressure prevailing within the high-pressure chamber, which is related to the transmitted tightening torque, the motional coupling between pulse unit 4 and motor 3 or the compressed-air supply to motor 3 can, e.g., be interrupted when a given maximum tightening torque has been reached.

The pulse unit 2 is filled with an incompressible medium, such as a hydraulic fluid. Upon rotation of the hydraulic cylinder 4 and the hydraulic sleeve 21, the seal rollers are moved inwards in their radial grooves and moved outwards, respectively, by the spring elements and the lift delaying means because of the eccentric arrangement of circles 30, 31. The seal rollers are in contact with the inside 22 of the hydraulic sleeve 21 only in a single rotary position of the hydraulic cylinder 4 over their total length. In this position, the fluid chamber 39 is separated into a high-pressure chamber and a low-pressure chamber. This position corresponds to the pulse transmission to the driven shaft 5. The transmission will only last until the seal strips 11,12 have swept over the seal rollers and have carried along the driven shaft by a certain rotary angle because of the different pressure ratios in the chambers. Thereafter, the pulse unit is again accelerated during the next turn of the hydraulic cylinder 4.

To avoid a second pulse already after another 180° turn, the lift delaying means and the rotational dynamics of the pulse unit ensure that hydraulic fluid is entirely exchanged via the relatively great play between radial groove and pulse roller and that the pulse roller is not influenced in its radial movement. The small play between radial groove 17 and compensating roller 6 does not permit an adequate exchange of hydraulic fluid during the short period for one revolution of the hydraulic cylinder, so that the radial movement of the compensating roller is limited or delayed because of the resultant negative pressure and the optionally smaller spring constant of the associated leaf spring 19.

As a result, the pulse unit can be accelerated via a full turn, which increases energy transmission to the screw/nut as compared with the transmission of two pulses each turn.

Finally, it should be noted that it is possible because of the subject matter of the application to obtain a pulse unit which, being of an almost identical structure, transmits two pulses each turn if seal rollers are used with the same diameter and radial grooves with the same width (relatively great play). As a result, smaller energy amounts can be transmitted at a higher pulse frequency.

Another possibility of using the pulse tool of the invention as a multiple and, in particular, a two-pulse unit is that in the last-mentioned case two of the above-described compensating rollers and pulse rollers are respectively provided in radial grooves of the driven shaft with corresponding lift delaying means for the compensating rollers. Two pulses are respectively transmitted to the driven shaft in this manner per turn of the hydraulic cylinder 4 with hydraulic sleeve 21.

Of course, corresponding seal strips and connection holes can be arranged by analogy for two compensating rollers and two pulse rollers.

I claim:

1. A pulse tool, comprising a pulse unit which includes a hydraulic cylinder including an inner wall, said cylinder being driven by a motor and a driven shaft supported in said cylinder, with two seal rollers each being displaceably supported in corresponding radial grooves of said driven shaft and power-operated outwardly toward said inner wall of said cylinder, said seal rollers being simultaneously in contact only in a single rotary position of said cylinder with corresponding seal strips that project relative to said inner wall of said cylinder so as to produce an angular momentum, one of said radial grooves comprising lift delaying means for restricting centrifugal movement of one of said seal rollers corresponding to said one of said radial grooves, said lift delaying means for causing said one of said seal rollers to serve as a compensating roller.

2. A pulse tool according to claim 1, wherein said seal rollers are arranged relative to one another such that they are offset by 180°, and said radial grooves are arranged relative to one another such that they are offset by 180°.

3. A pulse tool according to claim 1, wherein said lift delaying means is formed by said compensating roller being guided in said corresponding radial groove with less play as compared with the other of said seal rollers.

4. A pulse tool according to claim 1, wherein said compensating roller and the other of said seal rollers have the same dimensions, and said radial grooves have different widths.

5. A pulse tool according to claim 1, wherein said radial grooves have the same dimensions and a substantially rectangular cross-section which is open towards the circumference of said driven shaft, and said compensating roller and the other of said seal rollers have different diameters.

6. A pulse tool according to claim 1, further comprising a spring element and a bottom in each of said radial grooves, each of said spring elements arranged between said groove bottom and said seal roller in each said radial groove.

7. A pulse tool according to claim 6, wherein said spring element of said compensating roller has a smaller spring constant than that of the other of said seal rollers.

8. A pulse tool according to claim 6, wherein said spring element comprises a leaf spring.

9. A pulse tool according to claim 1, further comprising a hydraulic sleeve including an inside, said inner wall of said hydraulic cylinder being formed at least in the area of said seal rollers by said hydraulic sleeve, said seal strips arranged on said inside of said hydraulic sleeve.

10. A pulse tool according to claim 9, wherein pockets are provided on the inside of said hydraulic sleeve between said seal strips.

11. A pulse tool according to claim 10, wherein said pockets are defined by inner ring flanges which project radially from said inside of said hydraulic sleeve and along which at least said other of said seal rollers rolls.

12. A pulse tool according to claim 11, wherein said inner ring flanges define two circles which are concentric to one another and are eccentrically arranged within said cylinder and touched by said seal strips.

13. A pulse tool according to claim 11, wherein diametrically opposite sections of said inner ring flanges form ends of said seal strips.

14. A pulse tool according to claim 1, wherein the hydraulic sleeve and seal strips are arranged within said hydraulic cylinder between two lateral contact washers, one of said contact washers being next to said motor and resting on a radially inwardly projecting shoulder of said hydraulic cylinder and the other of said contact washers resting on a bearing ring which is adapted to be screwed into said hydraulic cylinder.

15. A pulse tool according to claim 1, further comprising a central hole concentric to said driven shaft and formed in said shaft at least over part of the length of said driven shaft.

16. A pulse tool according to claim 15, further comprising at least one respective connection hole formed in said driven shaft between said radial grooves, said at least one connection hole connecting said central hole and a fluid chamber formed between said driven shaft and said hydraulic sleeve.

17. A pulse tool according to claim 16, wherein said connection hole is radially formed in said driven shaft and offset by 90° relative to each said radial grooves.

18. A pulse tool according to claim 16, further comprising a throttle hole formed between said central hole and said connection hole with a cross-section that is reduced in comparison with the connection hole.

19. A pulse tool according to claim 18, further comprising a valve screw screwed into said central hole for closing said throttle hole in an infinitely variable and adjustable manner.

20. A pulse tool according to claim 16, further comprising a compensating piston positioned on and sealed relative to an end of said hydraulic cylinder that faces said motor.

21. A pulse tool according to claim 20, further comprising means for displacing said compensating piston relative to said hydraulic cylinder comprising a valve arranged between said compensating piston and said fluid chamber for applying pressure to said area of said compensating piston which is sealed relative to said hydraulic cylinder.

22. A pulse tool according to claim 1, wherein said pulse tool comprises a nutsetter.

23. A pulse tool according to claim 1, wherein one of said seal rollers is a pulse roller.

* * * * *